United States Patent [19]

Otteman et al.

[11] 4,169,486

[45] Oct. 2, 1979

[54] GAS SUPPLY SYSTEM WITH PURGE MEANS

[76] Inventors: John H. Otteman, 11940 E. Washington Blvd., Whittier, Calif. 90606; William M. Gray, 1191 Lenor Way, San Jose, Calif. 95128

[21] Appl. No.: 794,026

[22] Filed: May 6, 1977

[51] Int. Cl.[2] ..... B08B 9/02

[52] U.S. Cl. ..... 137/240; 15/406; 134/166 C; 222/148

[58] Field of Search ..... 137/237-241, 137/584; 134/166 C, 167 C, 168 C, 169 C, 22 C; 15/406

[56] References Cited

U.S. PATENT DOCUMENTS

| | | | |
|---|---|---|---|
| 2,070,517 | 2/1937 | O'Leary | 137/238 X |
| 3,215,560 | 11/1965 | Kredit | 15/406 X |
| 3,523,546 | 8/1970 | Berg | 137/240 |

*Primary Examiner*—Martin P. Schwadron
*Assistant Examiner*—Richard Gerard
*Attorney, Agent, or Firm*—Donald D. Mon

[57] ABSTRACT

A gas supply system including purge means. A supply conduit having an inlet and an outlet and a downstream direction of flow has within it a purge conduit with an inlet and a discharge port. The discharge port is directed upstream in the supply conduit and discharges adjacent to its inlet, whereby to purge that region of the supply conduit and to sweep gases from the entire supply conduit. The system is also provided with a selector valve able selectively to deliver gas to a delivery conduit or to a vent conduit or to shut them both off.

7 Claims, 5 Drawing Figures

V SEL
V CK
RV
G
V

GAS SUPPLY SYSTEM WITH PURGE MEANS

This invention relates to a gas supply system equipped with purge means.

Especially in the field of gas chromatography and semiconductor processes, wherein speciality gases are utilized and supplied from a source such as a pressure cylinder, it is useful to purge the system of residual gases before beginning an analysis or process. The system should be free from gases which might confuse the analysis or contaminate the process, and yet it must be connected to and disconnected from its gas supplies, and be run on different gases from time to time. These operations all tend to contaminate the system, so a purging technique is required. However, conventional purging systems fall short of the ideal, because often they leave "dead" areas where undesirable gases can remain. It is an object of this invention to provide a simple and effective purging means for a gas supply system.

A gas supply system according to this invention includes a supply conduit having an inlet and an outlet. A first source of gas can be connected to the inlet. The system also includes a delivery conduit and a vent conduit.

A selector valve has a first port connected to the outlet a second port connected to the delivery conduit, and a third port connected to the vent conduit. The selector valve is so constructed and arranged as selectively to interconnect the first and second ports in a first setting, the first and third ports in a sescond setting, and none of them in a third setting.

A purge conduit has an inlet and a discharge port, the purge conduit entering the supply conduit and extending upstream, so that the discharge port discharges gas upstream adjacent to the inlet of the supply conduit, thereby to purge this portion of the system. The purge conduit inlet is adapted to receive gases from a second source thereof. Valve means is provided in the purge conduit between its inlet and discharge port to resist discharge of gas therefrom.

The above and other features of this invention will be fully understood from the following detailed description and the accompanying drawings in which.

Figures 1, 2, 3, 4, 5:
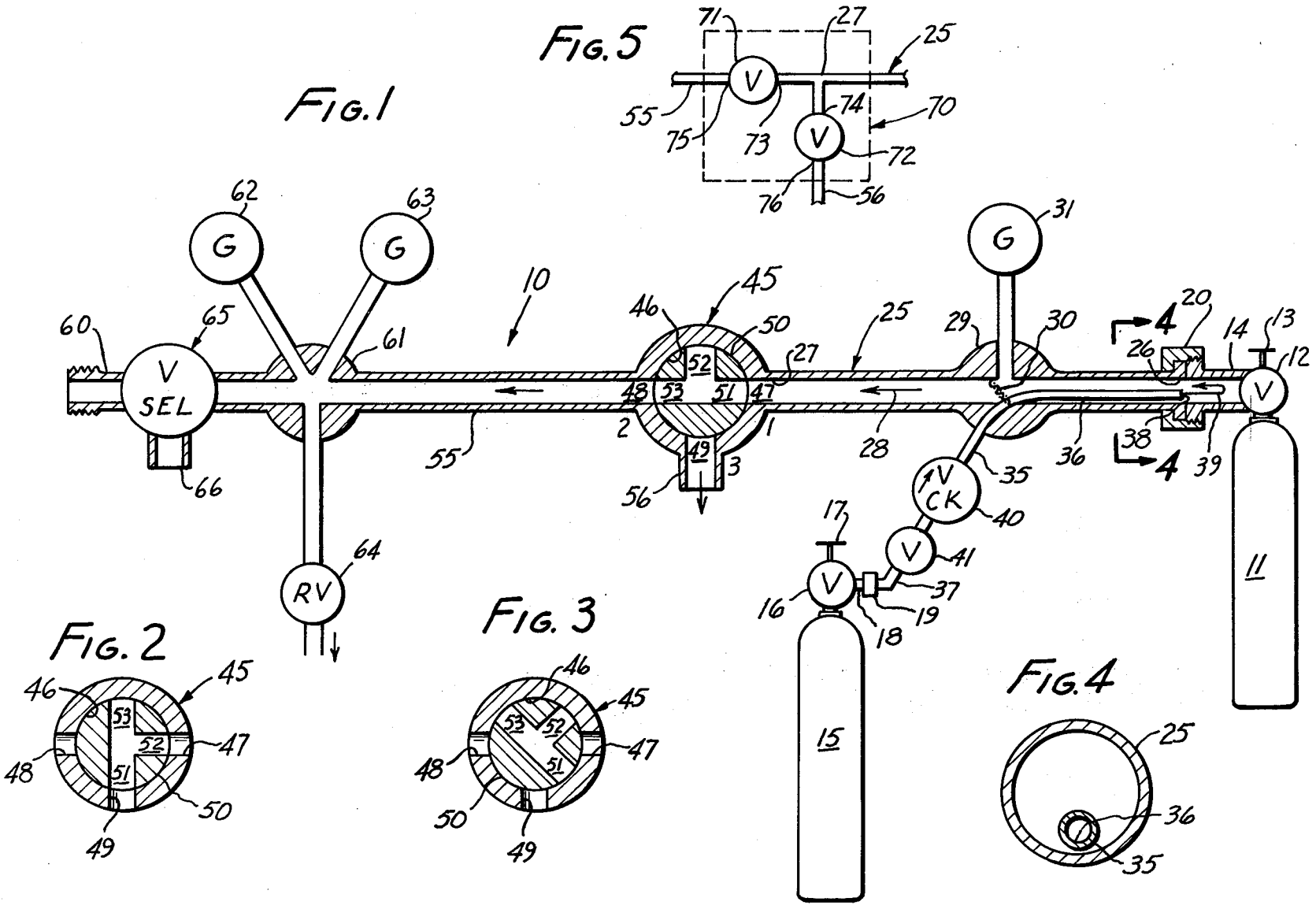
FIG. 1 is a schematic illustration of the presently preferred embodiment of the invention.
FIGS. 2 and 3 are schematic showings of two different settings of one of the valves in FIG. 1.
FIG. 4 is a cross-section taken at line 4—4 of FIG. 1.
FIG. 5 shows an alternate form of selector valve for use with this invention.

A gas supply system 10 according to the invention is shown in FIG. 1. Its objective is to permit the supply of a first gas (used in the analysis by gas chromatography, for example) from a source 11 thereof. In this embodiment the first source is a cylinder having a conventional pressure cylinder valve 12 which can be opened and closed by turning a handle 13. Gas is discharged from supply port 14.

A source 15 of a second gas (useful for purging the system) can be a gas cylinder 15 controlled by a valve 16 having a handle 17 to open and close it, and discharging gas through a supply port 18.

Couplings 19, 20 respectively couple the first and second sources to the system.

Supply conduit 25 is joined to coupling 20. Supply conduit 25 has an inlet 26 and an outlet 27. A downstream direction of flow is shown by arrow 28, which direction of flow is from said inlet toward said outlet. If desired, means such as a filter 29 can be incorporated into the supply conduit. This filter is schematically shown by screen 30. This is intended to exemplify any type of means for absorbing, screening, or otherwise removing deleterious material from the gas stream. A gage 31 can be coupled to the supply conduit to meter its pressure.

A purge conduit 35 enters the supply conduit as a separate conduit. It has a portion 36 extending upstream. It includes an inlet 37 connected to coupling 19 and a discharge port 38 which discharges upstream in the supply conduit. Discharge port 38 discharges gas at a high velocity in an upstream direction adjacent to the inlet of the supply conduit, preferably so that its discharge stream flows into supply port 14 so as to purge residual gases therefrom. This type of flow is schematically shown by arrows 39. The stream of purged gas turns to go downstream entraining with it such residual gases as it encounters. The purge conduit includes valve means which preferably comprises a unidirectional check valve 40 that permits flow of gas into but not out of the system. It requires a substantial opening pressure, certainly greater than atmospheric. In addition, the valve means may also incorporate, or instead may comprise an off/on valve 41. Preferably both types of valves are used together.

A selector valve 45 has a case 46 with a first port 47, a second port 48 and a third port 49. It also includes a rotatable plug 50 which has three interconnected branch connections 51, 52, 53 arranged in a T shape. Their angular extent, and also the angular extents of ports 47, 48, and 49 are such that the selector valve can have three individual and separate settings.

The first port is connected to outlet 27 of the supply conduit. The second port is connected to a delivery conduit 55. The third port is connected to a vent conduit 56. The selector valve is so constructed and arranged as selectively to interconnect the first and second ports in a first setting illustrated in FIG. 1, to interconnect the first and third ports in a second setting shown in FIG. 2, and to interconnect none of them in a third setting shown in FIG. 3.

The delivery conduit extends to a process gas coupling 60 adapted to receive process gas. The delivery conduit may optionally include a pressure regulator 61, and can also include a pair of pressure gages 62, 63. Each gage has a different pressure range. In addition, a relief valve 64 is provided to release exessive pressure which might be generated in the system.

An optional, second, selector valve 65 of the same construction as selector vavlve 45 is connected between regulator 61 and coupling 60. It has a vent 66. This enables the system to be blocked or vented at this downstream point, as well as at valve 45.

FIG. 5 shows an alternative form of selector valve 70, which can be directly substituted for either or both of valves 45 or 65. It comprises a first off-on valve 71, and a second off-on valve 72. The "first port" is the inlet side of both of the valves i.e. ports 73, 74. The "second port" is the outlet side 75 of valve 71. The "third (vent) port" is the outlet side 76 of valve 72. The valves can both be closed, or each opened while the other is closed, to perform the same function as either of valves 45 or 65.

The operation of the system will now be described. Assume that the selector valve is first set in the third setting of FIG. 3 (or the equivalent in FIG. 5). Then coupling 20 may be released and the gas cylinder removed and replaced. Then with the purge gas source 15 joined to coupling 19 and valve 41 opened, the selector valve may be set to the position of FIG. 2. Purge gas will then flow through the purge conduit 35, and blow into supply port 14, turn around and sweep residual gases along with it to the outlet and through the selector valve from the first to the third port, and out the vent conduit. After the purge flow has continued to the extent necessary to assure purging of previous gases, valve 41 is closed, or the source 15 simply removed from coupling 19, and the check valve will close, and thereafter the gas from the first source can be turned on to sweep through the system and in turn remove the purge gas through the vent conduit. Next, the selector valve can be moved to the first position shown in FIG. 1, and the system placed in operation there having been removed all of the residual gases.

The "two valve" selector valve of FIG. 5 is in all ways directly useful in the same way as valves 45 and 65, and the same terminology is applied to both.

The system can and will be constructed to provide least possible dead volume, and the selector valve can be designed to reduce its dead or inactive spaces.

The discharge port of the purge conduit is preferably provided in a nozzle shape so that the purged gases emit at a high velocity to assure the best purging and sweeping action.

This system allows usage of gas systems with a minimum of difficulty. The gas supplies can be removed and replaced with ease as can the filter. The downtime and purge time are materially reduced when compared with known purging systems.

Selector valve 66 can be closed to isolate the entire system from the process, or vented, as desired, in addition to providing for flow to coupling 60.

The system is shown for use with downstream user equipment, such as, but not limited to, a gas chromatograph, semi-conductor processing, or whatever, downstream from coupling 60. It is useful wherever a supply conduit should be purged, and the illustrated usage is not a limitation on the invention. This invention thereby provides an elegantly simple and effective means for purging gas supply systems.

This invention is not to be limited by the embodiments shown in the drawings and described in the description, which are given by way of example and not of limitation, but only in accordance with the scope of the appended claims.

I claim:

1. A gas supply system comprising:

a supply conduit having an inlet and an outlet, and a downstream direction of flow from said inlet to said outlet;

a delivery conduit;

a vent conduit;

a selector valve having a first port connected to said outlet, a second port connected to the delivery conduit, and a third port connected to the vent conduit, said selector valve being so constructed and arranged as selectively to interconnect said first and second ports in a first setting, said first and third ports in a second setting, and none of them in a third setting;

a purge conduit having an inlet and a discharge port-,said purge conduit entering said supply conduit, said discharge port being directed upstream in said supply conduit and discharging adjacent to the inlet of the supply conduit, said supply conduit inlet being adapted to receive a first gas from a valved source thereof, said purge conduit inlet being adapted to receive a second gas from a source thereof; and valve means in said purge line between its inlet and discharge port, whereby with the said selector valve in said second setting, said valve means can be opened to discharge second gas into said supply conduit to purge gases present in said supply conduit therefrom by sweeping action and discharge through the third port, and said valve means can then be closed and said selector valve be set in its third setting, and the source of first gas removed and replaced, and the selector valve can thereafter be returned to said second setting and said valve means opened for further purging with second gas, and thereafter said valve means can be closed to stop supply of second gas, and said selector valve can be set to said first setting to supply first gas to the delivery conduit.

2. Apparatus according to claim 1 in which the said valve means is an on-off valve.

3. Apparatus according to claim 1 in which the said valve means is a check valve permitting flow of gas in the purge conduit toward, but not away from, the discharge port.

4. Apparatus according to claim 1 in which said purge conduit extends inside the supply conduit, with its discharge port adjacent to the inlet port of the supply conduit.

5. Apparatus according to claim 1 in which filter means is incorporated in said supply conduit.

6. Apparatus according to claim 1 in which a pressure regulator is connected to said delivery conduit.

7. Apparatus according to claim 1 in which a second selector valve is connected to the second port of the first selector valve.

* * * * *